US005368359A

United States Patent [19]

Eakin

[11] Patent Number: 5,368,359

[45] Date of Patent: Nov. 29, 1994

[54] ACOUSTICAL CHAIR WITH SOUND ENHANCING HOOD

[76] Inventor: Byron C. Eakin, 3405 Ellenwood La., Tampa, Fla. 33618

[21] Appl. No.: 938,395

[22] Filed: Aug. 31, 1992

Related U.S. Application Data

[63] Continuation-in-part of Ser. No. 771,388, Oct. 3, 1991, Pat. No. 5,143,055, and a continuation-in-part of Ser. No. 238,424, Aug. 31, 1988, Pat. No. 5,097,821, and a continuation-in-part of Ser. No. 417,690, Oct. 5, 1989, abandoned.

[51] Int. Cl.[5] ..... A47C 7/62

[52] U.S. Cl. ..... 297/217; 297/327; 297/423.24; 297/423.3; 297/184.14; 5/904

[58] Field of Search ..... 297/327, 328, 423.23, 297/423.24, 423.3, 423.19, 217, 184.14; 5/904

[56] References Cited

U.S. PATENT DOCUMENTS

| | | | |
|---|---|---|---|
| 614,666 | 11/1898 | Petry . | |
| 868,633 | 10/1907 | Armstrong . | |
| 902,092 | 10/1908 | Latimer . | |
| 1,262,216 | 4/1918 | Lee . | |
| 3,025,108 | 3/1962 | Teague | 297/327 |
| 4,124,249 | 11/1978 | Abbeloos | 297/217 |
| 4,470,631 | 9/1984 | Powell | 297/217 |
| 4,797,934 | 1/1989 | Hufnagel | 297/217 |
| 5,083,834 | 1/1992 | Roach | 297/217 |

FOREIGN PATENT DOCUMENTS

| | | | |
|---|---|---|---|
| 1259088 | 3/1961 | France | 297/217 |

*Primary Examiner*—Flemming Saether

*Attorney, Agent, or Firm*—Dominik, Stein, Saccoccio, Reese, Colitz & Van Der Wall

[57] ABSTRACT

A chair comprising fixed arm portions laterally spaced from each other and a pivotable central portion therebetween. The central portion including a head end and a foot end. A hinge couples the arm portions and the central portion. Additionally, a drive members under the control of the operator effect pivoting of the central portion with respect to the side portions. The chair further includes a foot rest. The foot rest comprises an adjustment rachet for coupling the foot rest to the foot end of the central portion. The adjustment rachet has horizontal rods reciprocable into and out of cylinders within the central portion. Additionally, depending rods fixedly secured within the foot rest are pivotally coupled to the horizontal rods and cylinders. Furthermore, the chair includes speakers within the central portion. The speakers are controlled by the operator. When the operator is seated in the chair, the operator may audially and tactically enjoy the created sound. The speakers further include a pair of speakers facing each other in the head end of the central portion. Finally, the chair comprises a hood pivotally secured at the upper extent of the head end between the speakers.

4 Claims, 9 Drawing Sheets

ACOUSTICAL CHAIR WITH SOUND ENHANCING HOOD

This is a continuation-in-part of my pending applications for "Somatic Acoustic Chair" Ser. No. 07/771,388 filed Oct. 31, 1991, now U.S. Pat. No. 5,143,055 issued Sep. 1, 1992 and "Somatic Musical Exposure System" Ser. No. 07/238,424 filed on Aug. 31, 1988, now U.S. Pat. No. 5,097,821, issued Apr. 24, 1992 and Ser. No. 07/417,690 for "Acoustic Chair" filed on Oct. 5,1989, now abandoned all of, which are incorporated by reference herein.

BACKGROUND OF THE INVENTION

1. Field of the Invention

This invention relates to means and methods whereby a recumbent listener exposed to music experiences not only audible sensations but also tactile sensations therefrom.

2. Description of the Background Art

Since time immemorial, music has been recognized as being somehow soothing to the spirit as well as pleasing to the ear. Many people believe they work or study better within a musical environment, and some types of music are considered relaxing. Many recent developments in sound generation and reproduction equipment have accentuated and facilitated music appreciation. Music has its repetitive aspect, also it is not surprising that music is common in active and passive exercise. Music encourages such bodily activity as dancing and is now a common accompaniment to individual or group exercise program. Bodily well-being is enhanced by voluntary exercise, but if such exercise is impracticable or is not well distributed throughout the body or is carried to excess, a form of passive exercise of "massage" often proves beneficial.

Similarities between repetitive exercise, massaging movements, and various mechanical actions have led to numerous mechanized beds, chairs, and tables. Efforts have also been made to apply musical or other acoustic/sonic vibrations to more of the body than the ears. However, nobody besides the present inventor seems to understand that the degree of coupling between the musical or other acoustic vibrations and the body is critical or how to accomplish it for the benefits sought. Loose coupling and tight coupling are inoperative because the former does not vibrate the body enough and the latter vibrates it too much, except where the body support is affixed to an inert frame (nullifying the coupling). The problem is even more acute with chairs, where diverse parts of the body are being supported variously, as compared with beds or the like, where all or most of the body is being supported generally horizontally.

Nohmura in U.S. Pat. Nos. 3,880,138 and 4,055,170 and Martimaas in U.S. Pat. No. 4,023,566 disclose sitting or reclining means with loudspeakers directed toward the back of the person thereon, but their systems are too loosely coupled to the supported person to be effective. Other inventors have employed liquids for transmitting various vibrations to the body, but such systems are too tightly coupled to be conducive to relaxation and acoustic benefits.

My somatic acoustic exposure system replaces the deficiencies of the prior art with new levels of entertainment and passive exercise plus related benefits for persons so exposed. Such benefits are attainable in a chair, especially one that enables the sitter to adjust its orientation from a sitting through a semi-reclining to a recumbent position, with head, body, and limbs all being supported.

SUMMARY OF THE INVENTION

A principal object of the present invention is to enhance the overall exposure of a listener to musical vibrations despite shifting movement of the listener from and to a sitting position and a recumbent position via an intermediate semi-reclining position.

Another object of this invention is to transmit musical vibrations to the body as well as to the ears of a listener, regardless of whether such listener is sitting or lying down.

A further object of the invention is to accomplish the foregoing objects in a somatic acoustic chair convertible from an upright to a reclining position.

In general, the objects of the present invention are attained via housing means defining an acoustic chamber supplied with music or other desired sound and partially decoupled by intervening resilient means from external supporting means. Such apparatus features a supporting frame, substantially rigid person-supporting means carried resiliently by the frame, a sound housing also carried by the frame and forming an acoustic chamber open toward the person-supporting means. More particularly, the person-supporting means, though substantially-rigid, comprises a plurality of relatively movable portions supporting diverse parts of a person's body.

Other objects of this invention together with means and method for attaining the various objects will be apparent in the following description and the accompanying drawings of a preferred embodiment thereof, being presented by way of example rather than limitation.

BRIEF DESCRIPTION OF THE DRAWINGS

FIG. 1 is a side elevation of an acoustic chair of this invention, in a generally upright position.

FIG. 2 is a side elevation of the same chair, inclined from the previous upright position to a partially reclined position; and FIG. 3 is a side elevation of the same chair, fully reclined.

FIG. 4 is a front view of the uncovered chair of FIGS. 1 to 3.

FIG. 5 is a rear view of the same chair; and

FIG. 6 is a sectional plan view, taken at VI—VI on FIG. 4.

FIG. 7 is an oblique view of the chair of the preceding views, partly disassembled, viewed from a vantage point at its upper left;

FIG. 8 is a fragmentary sectional elevation in the vicinity of the assembly points of the same chair, taken at VIII—VIII on FIG. 6;

FIG. 9 is a medial side sectional elevation of the same chair, taken at IX—IX on FIG. 4.

FIG. 11 is an elevation taken from the left and partly forward of the same chair;

FIG. 12 is a plan view of the same chair in an upright position;

FIG. 13 is a front elevation of the same upholstered chair; and

FIG. 14 is a rear elevation of the same chair shown previously.

FIG. 15 is a front perspective view of the chair showing the hood in a closed lowered position.

DETAILED DESCRIPTION OF THE INVENTION

Figure 1:
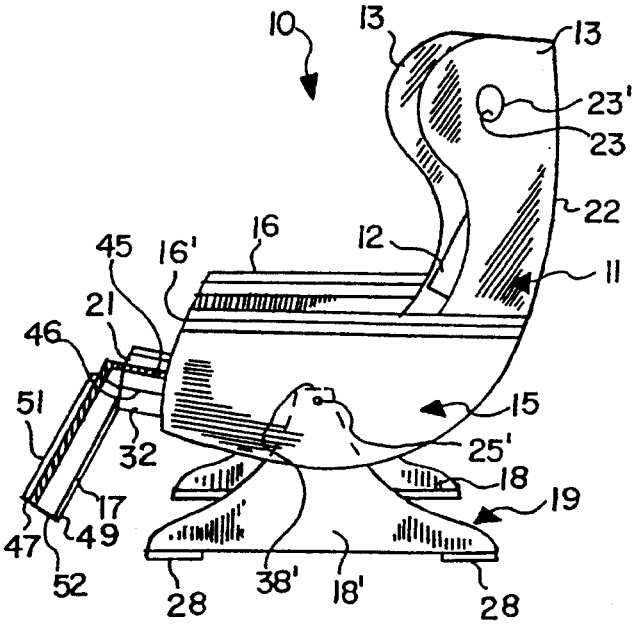
FIGS. 1 through 9 shown an acoustic chair of the present invention uncovered so as to reveal its internal structure.

FIG. 1 shows, from the left side slightly above the horizontal, acoustic chair 10 of the invention on base 19 and without upholstery and cushions (shown later), and featuring as principal components: back 11, body 15, foot rest 17, with framework supported directly or indirectly by the base, and with person-supporting members carried resiliently relative to the framework. The back component has back rest 12 as such support for a person's back, has exterior backing 22 as such framework, and is flanked by right and left wings 13, 13' shown with respective speaker openings 23, 23' therein. The body component has pair of right and left sides 14, 14' with arm rests 16, 16' as part of such framework, flanking seat 21 as such support for a person's body. The set is a bit narrower than the spacing between the sides and rests on resilient strip 45 overlying the perimeter of baffle 46 carried at the front by transverse support 32 attached to the two sides. Foot rest component 17 is attached pivotally to mechanism (not visible) under the seat of the body component, hangs down not quite vertically to the left of the view (front of the chair), and includes outer rest layer 51 as such support for a person's legs and feet, on top of resilient strip 47 to baffle 48, which is spaced by spacer 38 from outer bottom layer 49 as such framework.

The base component has pair of right and left generally triangular uprights 18, 18' resting on corner pads 28. Horizontally pivot pin 25' (to enable. the body and back of the chair to recline) is visible in an opening in the near side of the chair, aligned with a vertical fore-to-aft bisector of the base. Top apex 38' (dashed lines) of upright 18' has a horizontal bore receiving pivot pin 25' as top apex 38 of base upright 18 receives pin 25 (not seen here).

Figure 2:
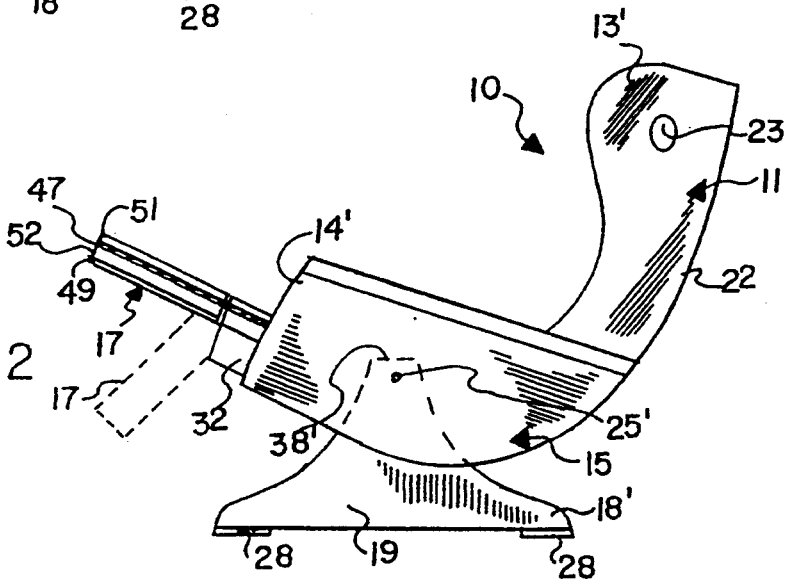

FIG. 2 shows same chair 10 viewed directly from the left and differing from FIG. 1 mainly in having back 11 and body 15 components tipped backward about pivot pin 25' to an intermediate or semi-reclining position. In this position, the back component and the body component, though tipped backward, otherwise remain in their original relative orientation. Foot rest 17 is shown tipped up from its original position (dashed lines) into alignment with seat 21 in this intermediately recumbent position.

Figure 3:
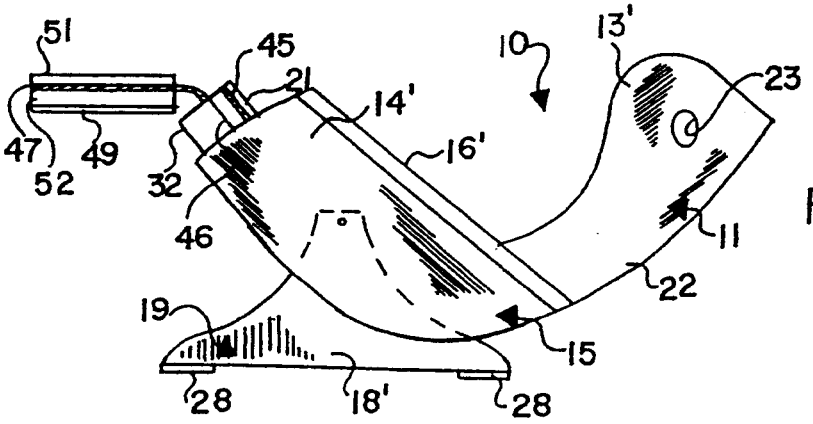

FIG. 3 again shows chair 10 from the left, differing from FIG. 2 in having back component 11 and body component 15, with their related parts, tipped further backward about pivot pin 25' (and opposite pin 25, not visible here) to a fully reclining position, in which foot rest 17 is substantially horizontal, at a setting between the extremes of its positions in Figs. 1 and 2. In this fully reclined position, the back rest and the seat form an upright V-configuration, while remaining in their original orientation relative to one another, although now tipped further backward.

Figure 4:
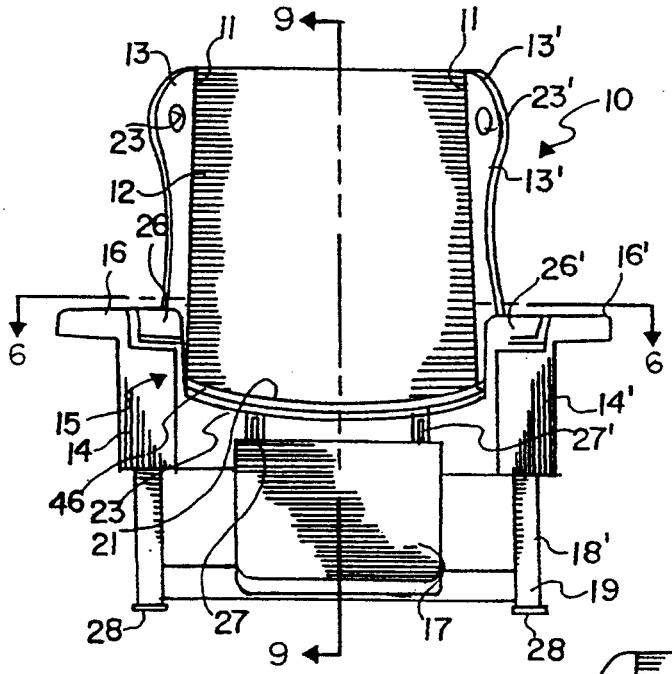

FIG. 4 shows chair 10 upright and viewed from the front. Respective speaker openings 23, 23' are obliquely visible in wings 13, 13' of the back component. Narrower and lower arm rests 26, 26' are recessed along the inside edges of arm rests 16, 16'. Spaced from sides 14, 14' the side edges of seat 21 rest on resilient layer 45 on top of baffle 46 (seen edge-on) on transverse support 32. Right and left pivoted links 27, 27' through openings in the front of that transverse support carry foot rest 17, which has top outer or rest layer 51 resting on resilient layer 47. Baffle 52 (sen edge-on) underlies the resilient strip and is underlain by spacer 49 to bottom outer layer 49. Transverse member 29 joins base uprights 18, 18' just above the floor level of underlying pads 28.

Figure 5:
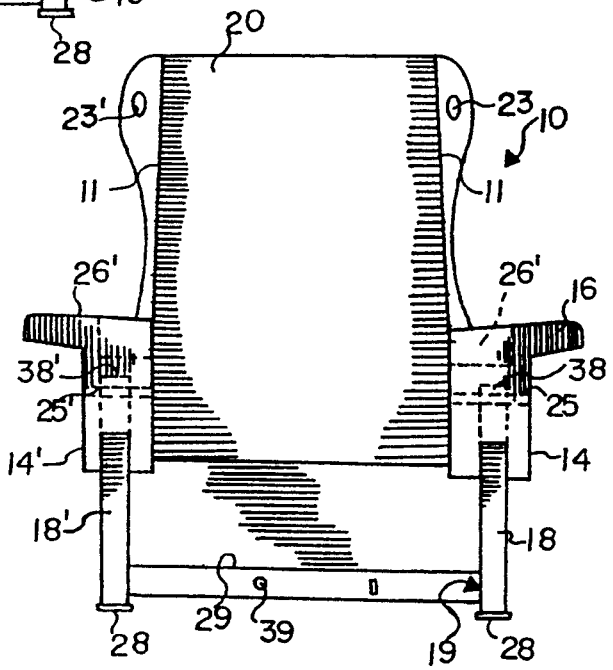

FIG. 5 shows chair 10, still upright, from the back. Pivot pins 25, 25' (dashed lines) occupy horizontal bores in sides 14, 14', below arm rests 16, 16' (and lower arm rests 26, 26') and aligned bores in upper ends (dashed lines) of base uprights 18, 18'. Wiring pigtail 39 is visible entering an opening in the transverse member.

Figure 6:
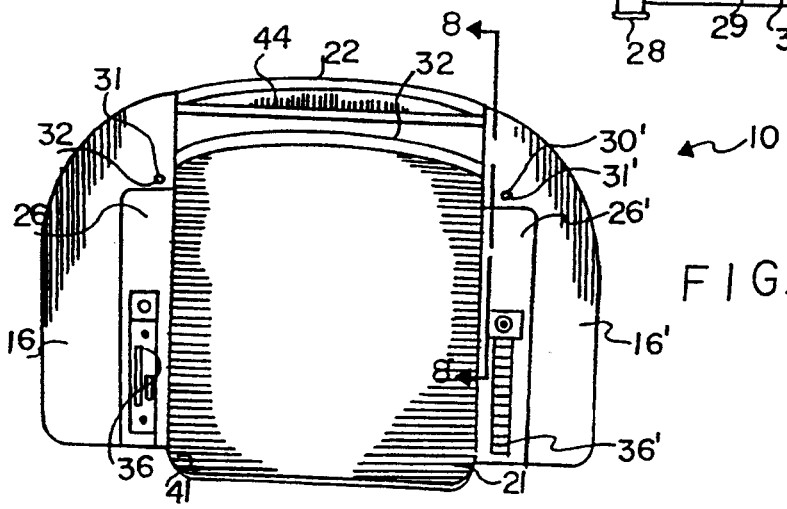

FIG. 6 shows chair body component 15 from above, sectioned through outer backing 22, baffle 44, and lumbar part 32 of back rest 12——spaced from one another and shaded for wood——at substantially arm rest level, as indicated at VI—VI on FIG. 4. Seat 21 is flanked by, and spaced edgewise from, right and lower arm rests 26, 26'. Visible in the upper arm rests just aft of the recesses for the lower arm rests are pair of bores 30, 30' receiving supporting pins 31, 31' (sectioned here) for back component 11 (shown fragmentarily in section between the arms). The recessed lower arm rests have electrical controls 36 36' inset in their forward portions.

Figure 7:
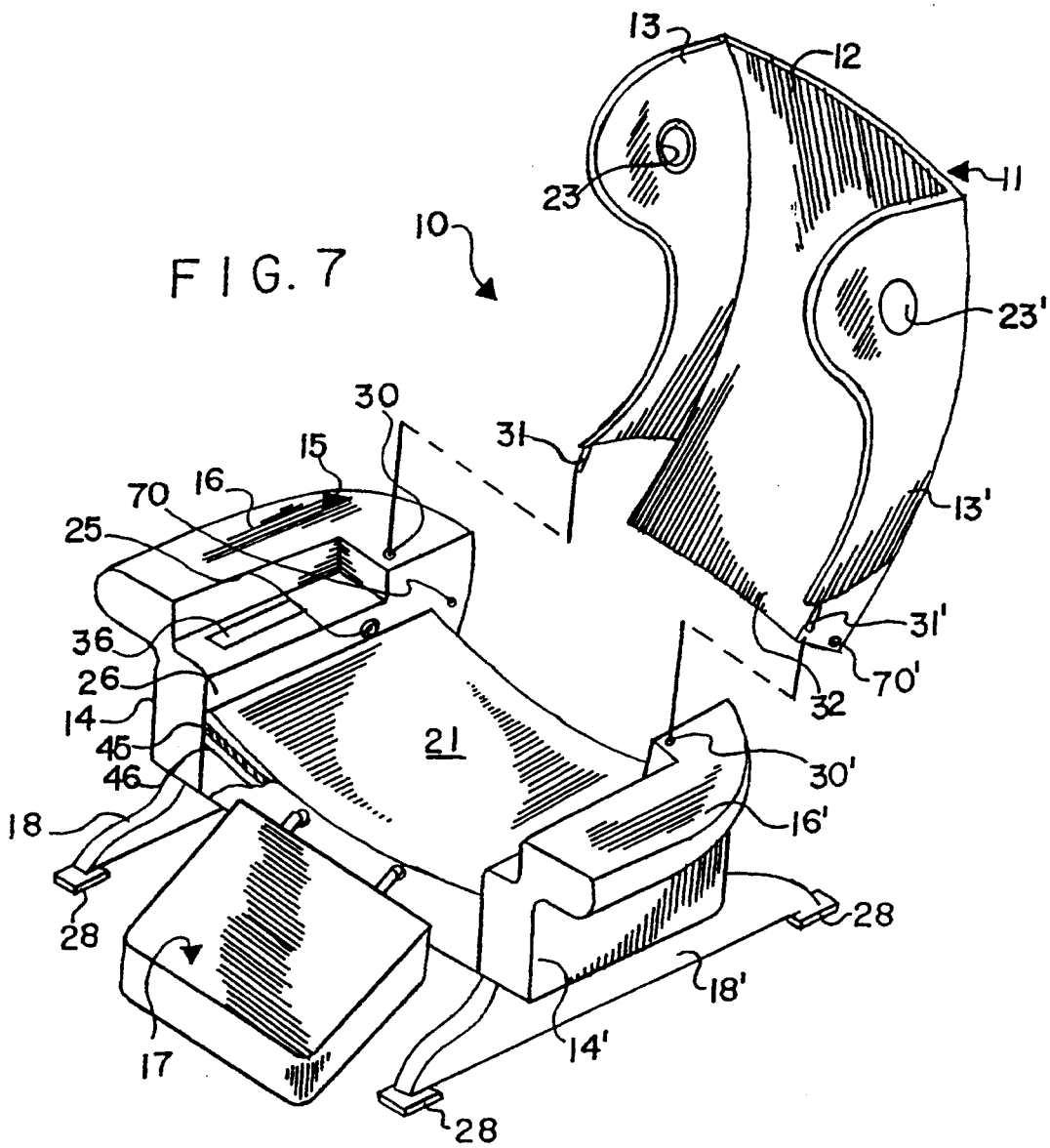

FIG. 7 shows chair 10 in partially exploded perspective , with back 11 shown disassembled from body 15. Pins 31, 31' protrude down from respective wings 13, 13' in position to enter respective bores 30, 30' in the aft portion of upper arm rests 16, 16' where they normally remain unless and until the chair manually disassembled, as for shipment. Lateral bore 70' behind and below pin 31' is one of a pair adapted to receive retaining screws (see next view) to supplement gravity in securing the back to the body of the chair. Lumbar portion 32' of back rest 12 in FIG. 7 fits within the inside edges of sides 14, 14' and abuts the aft part of seat 21 when the back is assembled to the chair body. Seat 21 on resilient strip 45 back (on baffle 46) is spaced from the sides as well as from the back.

Figure 8:
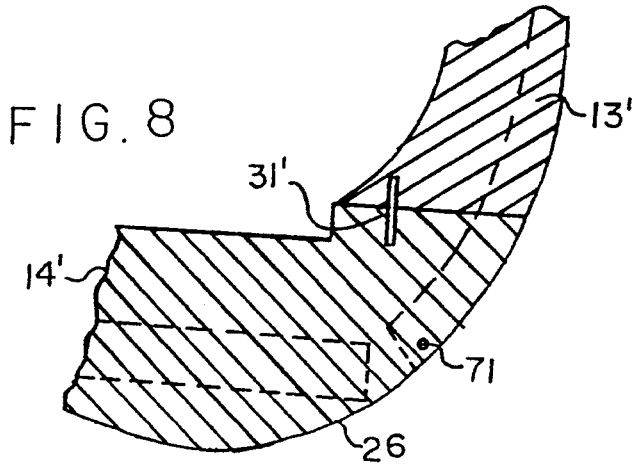

FIG. 8 shows pin 31' and vicinity, partly cut away, with back 11 assembled to body 15, as indicated at VIII- —VIII on FIG. 6. Transverse screw 71' (in bore 70'——with like screw 71 in bore 70 on the other side) holds them together, supplementing gravity as noted.

Figure 9:
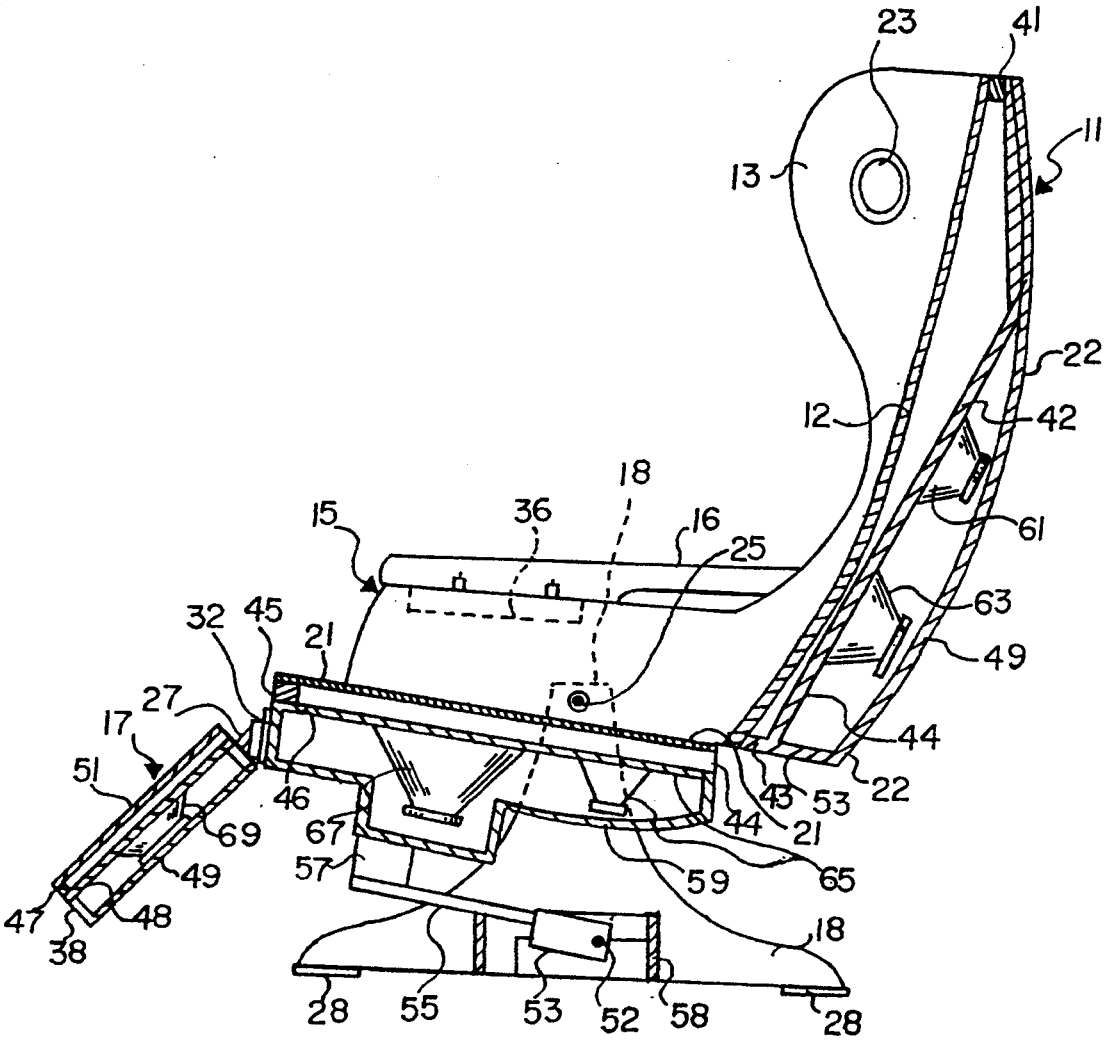

FIG. 9 shows chair 10 in medial vertical section, as indicated at IX—IX on FIG. 4, featuring otherwise concealed members, such as for support and for sound-emission, in the chair interior. Between back rest 12 and outer backing 22 is baffle 42 supported at its upper end against the inside wall of the backing and at its lower end against intervening rigid piece 53 secured to the backing, thereby forming a sound housing. Baffle 42 carries speakers 61 and 63 (in suitable openings) directed toward the back of back rest 12. Baffle 46 underlying seat 21 forms a sound housing with underlying chair bottom 59 and rigid transverse supports 32 along the front edge and 39 along the back edge (and like supports along sides 14, 14'). Baffle 46 supports speakers 65 and 67 directed upward toward the seat. Foot rest component 17 has, as before, outer rest layer 51 on top of resilient strip 47 to baffle 48, which is spaced by spacer 52 from outer bottom layer 49. The base component has cross-members 58 orienting uprights 18, 18' and supporting pivot pin 52' for bidirectional motor 53, which turns shaft terminating in bracket 57 affixed to bottom 59 of the chair to control its orientation in the range from upright to fully reclined.

FIGS. 10 to 14 show chair 110——so designated because it is now fully upholstered and cushioned, greatly modifying its appearance, and with its identified components, parts, or portions designated by one hundred more than the corresponding items previously shown bare. It will be understood that the degree of cushioning absorbs some of the acoustic vibration applied to the body via its relatively rigid body support coupled resiliently to the chair frame, the chair remains distinguished by such support as compared with chairs that support the body either on a relatively vibration-proof rigid frame or more directly on a sling or similar flexible or cushioned support.

Figure 10:
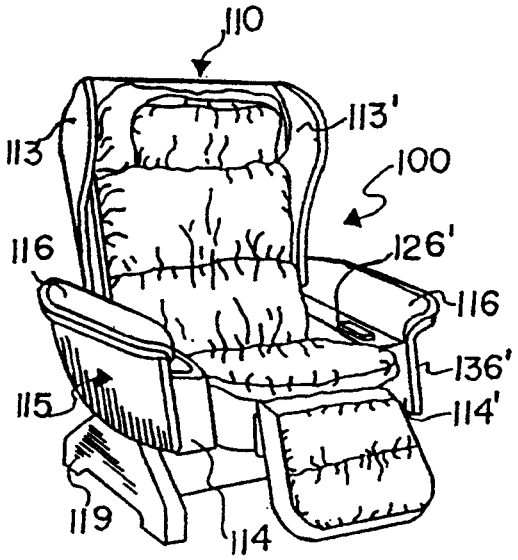
FIG. 10 is a perspective view, from the upper right of the same chair, shown upholstered and cushioned.

FIG. 10 shows acoustic chair 110 in perspective from a largely front and slightly right-side oblique vantage point at a level somewhat above the arms, showing back component 111, body component 115, foot rest component 117, and base component 119. Included are head-high right and left wing portions 113, 113', sides 114, 114' with bi-level arm rests 16, 126 on the right and 16', 126' on the left, and electrical controls 136, 136' on the lower arm rests.

Figure 11:
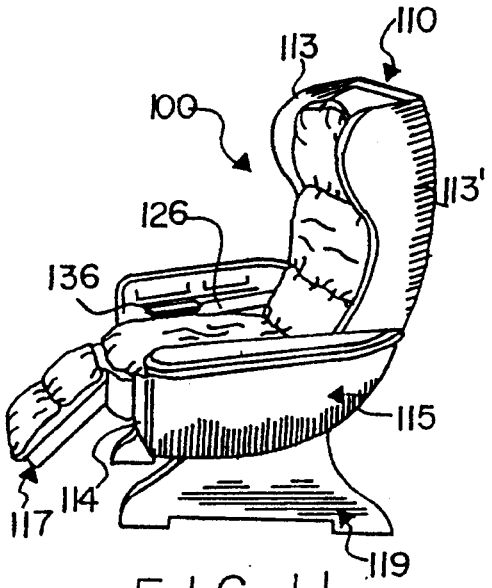
FIGS. 11 through 15 show the chair completely upholstered and cushioned.

FIG. 11 shows chair 110 from a largely left-side and slightly front oblique vantage point, showing substantially the same features as in FIG. 1, from a different azimuthal position, including more of the fore-to-aft extent of the wings of the back, more of the right armrest, and more of the vertical extent of the base from the side.

Figure 12:
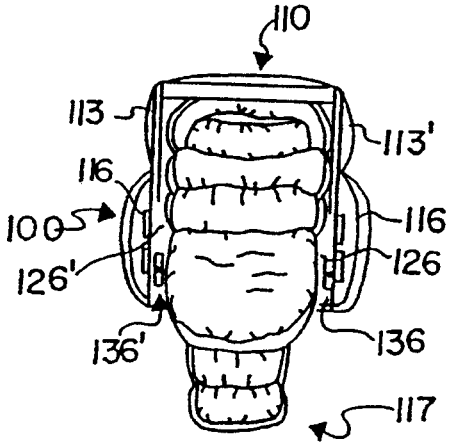

FIG. 12 is a top plan view of chair 110, emphasizing its head, back, and seat cushions, also convexity of the seat cushion outline to the front, and the forward extent of the foot rest.

Figure 13:
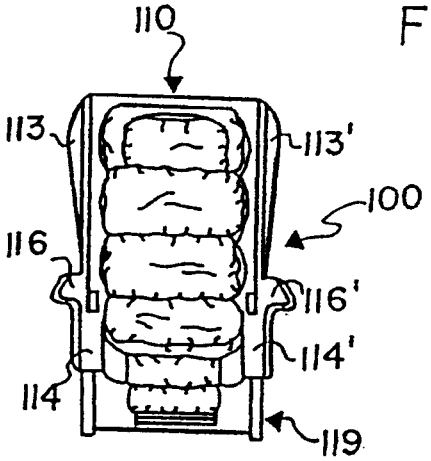

FIG. 13 shows chair 150 from the front, featuring the cushions, armrests, and base.

Figure 14:
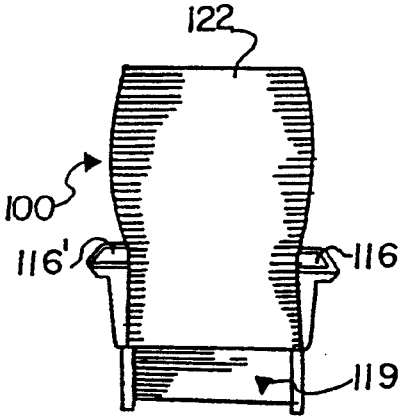

FIG. 14 is the simplest view, showing chair 110 from the back, showing also part of the arms and part of the base.

Operation of the acoustic chair of this invention is readily understood from the foregoing description and the accompanying diagrams. The base carries the chair so that the back and body components can be tipped backward via suitable mechanism at the control of the seated person through semi-recumbent or reclining positions to a more extreme recumbent or reclined position. Music or other desired sound is provided from speakers as shown or from equivalent sonic means and directed from the sound housing toward not only the ears but also the back, seat, and legs of a person so seated.

Although cushioned to a comfortable extent, the back, seat, and legs of a person seated on the chair are carried on relatively rigid members that in turn rest upon resilient strips interposed between the person-supporting members and the general framework of the chair carried pivotally by the base. In this important respect this chair differs from previously known chairs, which either couple a person support tightly to an immovable framework, in which event there is little result; or through interposed liquid, in which event the person is pounded undesirable as soon as enough power is expended to vibrate the incompressible water mass; or loosely to a sling or other insufficiently rigid support, in which event there is little effect except upon the ears of the person as is conventional.

Addition of cushions renders the relatively rigid person-supporting member of this chair more comfortable to a person supported thereon without damping out the sonic vibration transmitted to the person via the resilient coupling to respective framework members.

Also noteworthy is that the chair's back rest and seat, though reclinable together, are not affixed to one another at their junction but instead are individually resiliently carried relative to the framework supported by the base. This arrangement enables them to move relatively independently and substantially perpendicularly to one another in response to applied acoustic vibration. It also is conducive to limitation of the sound laterally to the immediate vicinity of the chair rather than flooding the surroundings with it.

No special materials are required for this acoustic chair. The base and framework are preferably wooden, or alternatively plastic, metal of composite of equivalent rigidity. The resilient material on which the back, seat, and legs of a person in or on the chair are supported may be suitably durable elastomer, such as natural or synthetic rubber or foamed polyalkylene, polyurethane, or the like. The resilient material need not cover the underlying strips along edges or around the perimeter or optionally from side to side intermediately, in width adequate to support the person's weight without excessively absorbing or damping the sound applied to the person therethrough.

Although maintaining the relative orientation of back rest and seat unchanged throughout reclining orientations is preferred, other arrangements may be employed, even if at some sacrifice in benefits. Thus, the chair back may be hinged to the chair body, instead of pinned thereto, so as to enable the intervening angle to be varied.

Figure 15:
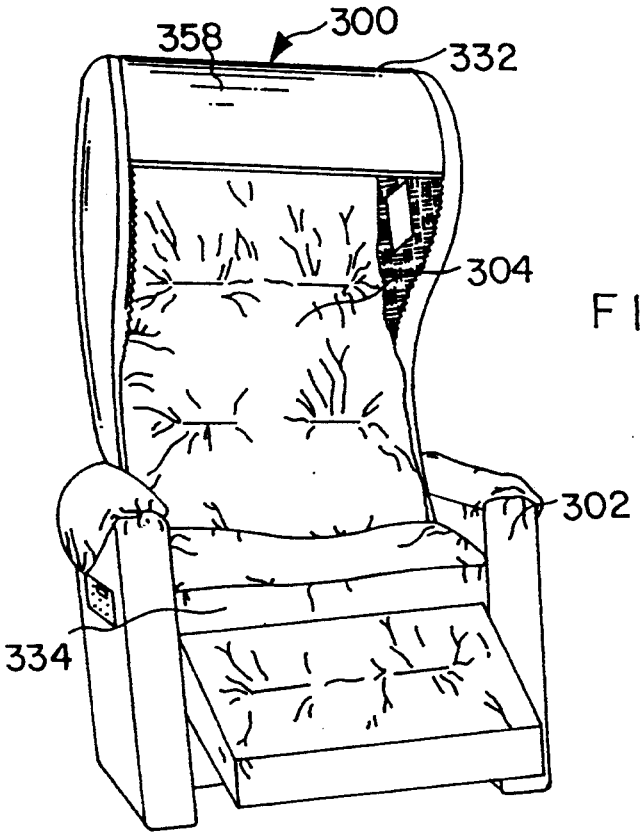

The chair 300 of the embodiment beginning with FIG. 15 has fixed arm portions 302. The arm portions are laterally spaced from each other. Further includes a pivotable central portion 304 between the arm portions. Hinge means formed as pins 306 couple the arm portions and the central portion. A drive means, similar to that of the prior embodiments, under the control of the operator effects the pivoting of the central portion with respect to the side portions. Sound creating means 310, 312, 314 within the central portion is under the control of the operator. Therefore, when seated in the chair, the operator may audially and tactically enjoy the created sound.

Furthermore, the central portion of the chair includes an upper back component 318 and a lower seat component 320. A bracket 322 couples the back and seat components. Additionally, the hinge means includes a hinge pin 306 extending through each bracket and each arm portion. This arrangement comprises fixed arms and a central point that moves in a simplified single pivot point arrangement without complicated articulated movement.

The chair 300 further includes a foot component 326. The foot component is pivotally and reciprocally coupled to the end of the seat component remote from the back component. The foot component allows for the component to be recessed into the lower seat component and thereby extend downwardly so that getting into the chair in a conventional manner is equally convenient for young and old people. Once the operator is in the chair, the foot component can be moved to any one of a plurality of operative positions (in the same manner as in my prior pending applications) through a manually controlled rachet arrangement 328. However, electronic controls and motor can be added to the chair. Further, the foot component of the present invention extends across the full width of the central section for greater convenience to the user. Thereby avoiding the requirement that the user spread his legs and stand and subsequently dropping his center of gravity downwardly in a straddling arrangement.

This embodiment of the invention comprises a chair 300 including fixed arm portions 302 laterally spaced from each other and a pivotable central portion therebetween. The central portion has a head end 332 and a foot end 334. A foot rest with adjustment means couples the foot rest to the foot end of the central portion The adjustment means has horizontal means such as rods 338 reciprocable into and out of the central portion and depending means such as rods 340 fixedly secured within the foot rest. A pivoting component, the rachet 328 is positioned between the horizontal and depending means.

Figure 18:
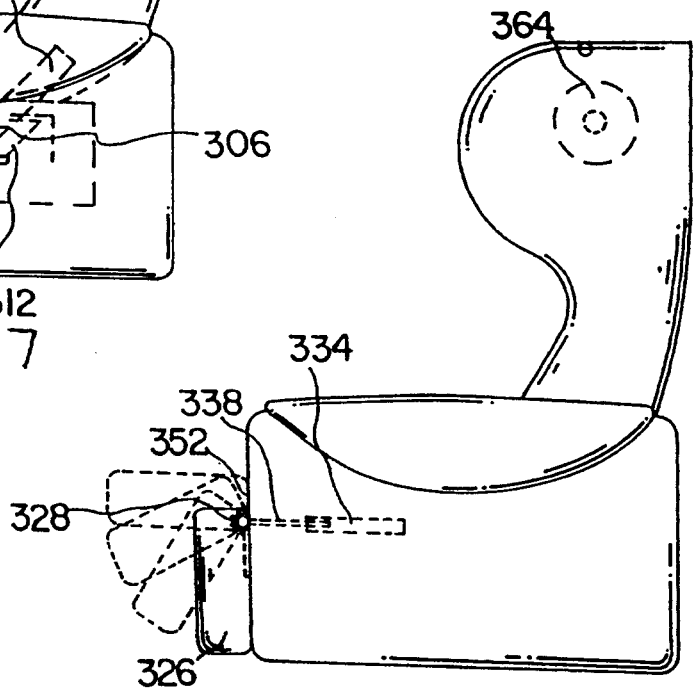
FIG. 18 is a vertical section through the chair showing the foot rest in an extended position.

Additionally, the horizontal means includes a pair of laterally spaced fixed cylinders 344 within the foot end 334 of the central portion. The chair further includes a pair of rods 338, each reciprocable along its length into and out of an associated cylinder 344. Furthermore, the depending means includes brackets, such as rods 340, within the foot rest 326 coupled to the rods and the pivoting component includes a ratchet 328 to hold the foot rest at any of a plurality of angular orientations with respect to the central portion. Note FIG. 18.

Figure 19:
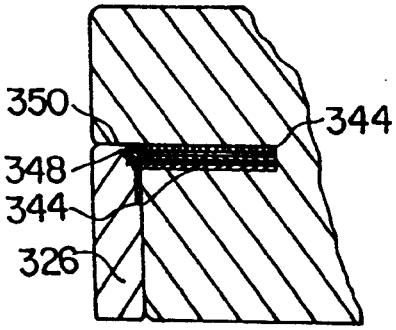
FIG. 19 is an enlarged section of the chair showing the foot rest in a retracted position.
Figure 20:
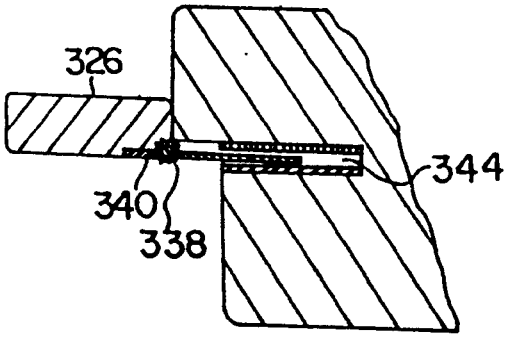
FIG. 20 is an enlarged section of the chair showing the foot rest in an extended position.
Figure 21:
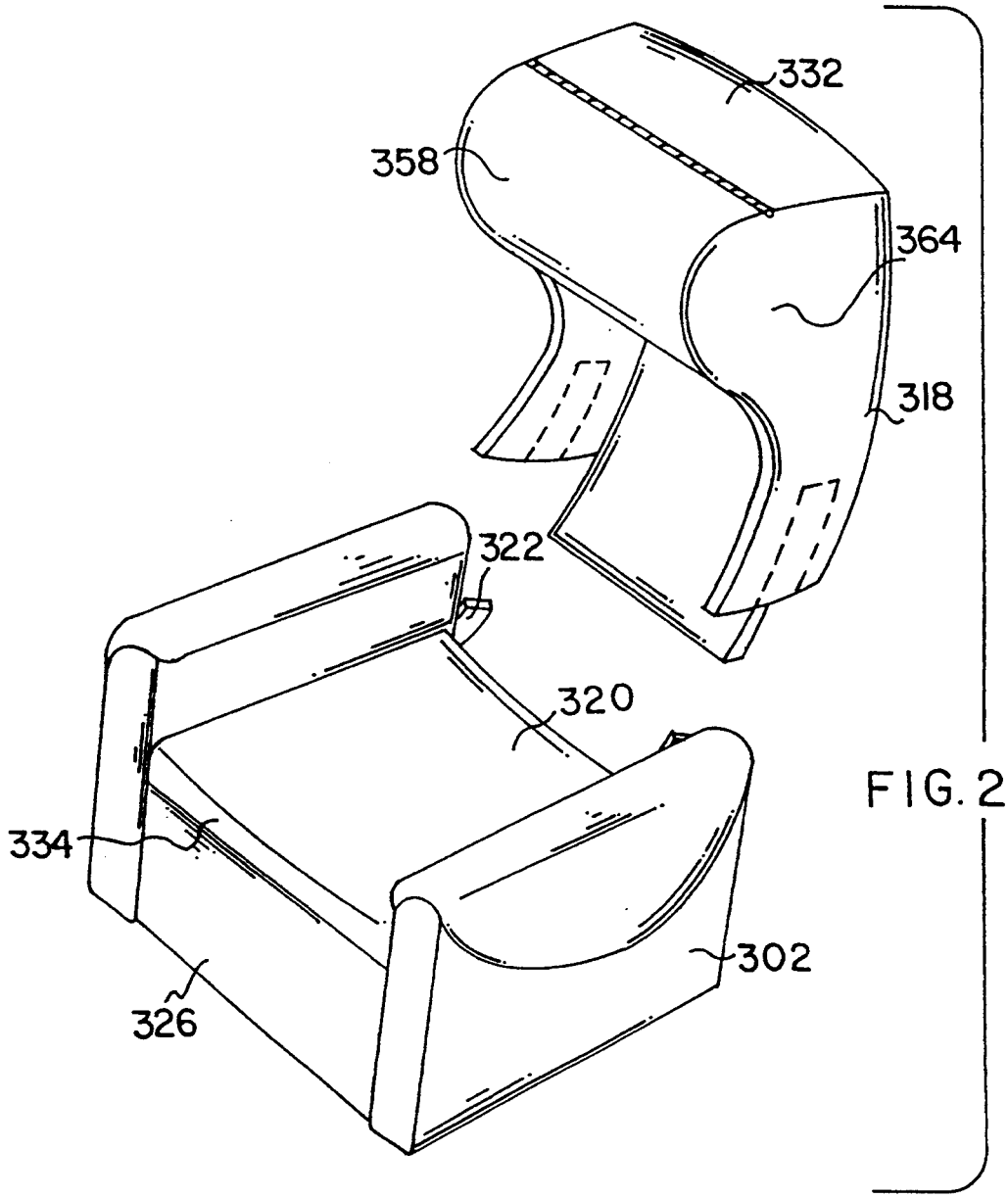
FIG. 21 is an exploded perspective of the chair showing the upper back component and lower seat component.
Figure 22:
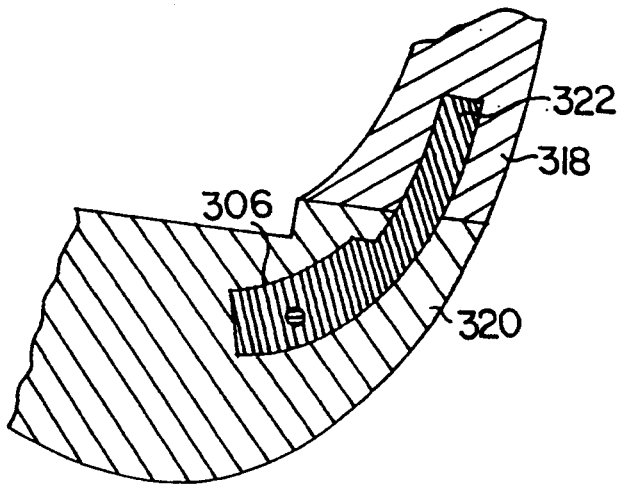
FIG. 22 is section through the chair showing the L-shaped bracket for coupling the back and seat components.

The depending means includes brackets within the foot rest coupled to the rod. The foot rest includes a face 348 positionable in facing relationship with the lower face 350 of the foot end when the foot rest is retracted. Note FIG. 19. The face 348 is in facing relationship with the front face 352 of the foot end when the foot rest is extended. Note FIG. 20.

A further feature of the invention comprises a chair 300 having fixed arm portions 302 laterally spaced from each other and a pivotable central portion 304 with a head end 332 and a foot end 334 therebetween. Hinges 306 couple the arm portions and the central portion. A sound creating means 310, 312 and 314 within the central portion is under the control of the operator. When the operator is seated in the chair, the operator may audially and tactically enjoy the created sound. The sound creating means includes speakers 356 facing each other in the head end of the central portion and a hood 358 is pivotally by a hinge 360 secured to the head end between the speakers.

Figure 16:
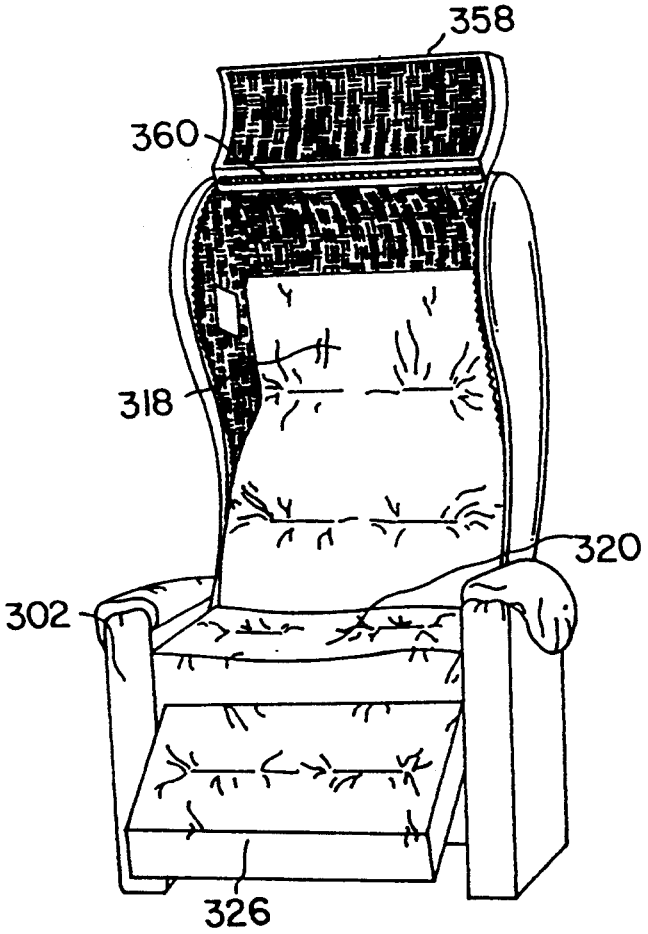
FIG. 16 is a front perspective view of the chair showing the hood in an opened raised position.
Figure 17:
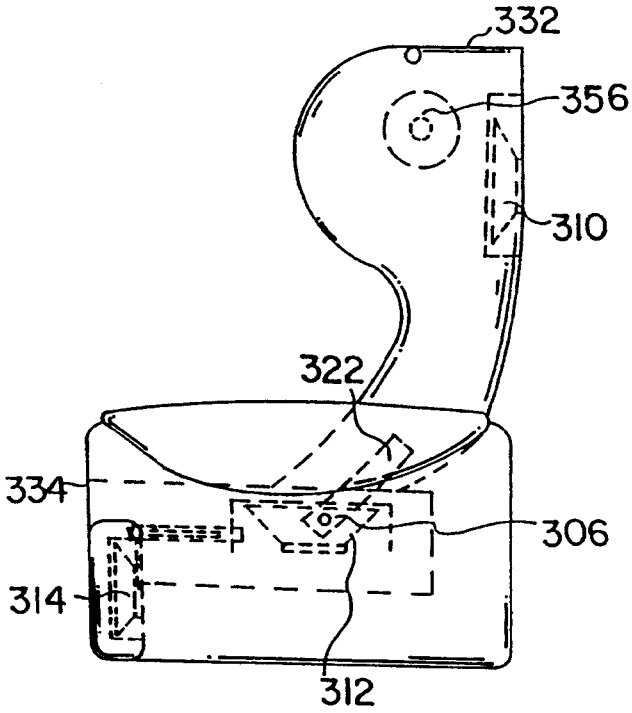
FIG. 17 is a vertical section through the chair showing the foot rest positioned in a retracted position.

The use of a hood encompasses a major portion of the user's head. The hood comprises side wings 364 that are enlarged. The side wings include speakers for audio perception. The hood 358 pivots upwardly during entry and exit of the user. Note FIG. 16. The hood pivots downwardly to contain desirable sounds and update intrusion by extraneous sounds ambient of the head zone. Note FIG. 16. Enjoyment of the audio sounds is thus maximized with physical receipt of the vibrations by the foot rest as well as in the main central portion by the seat and back in addition to the ears through the speakers in the hood.

Figure 23:
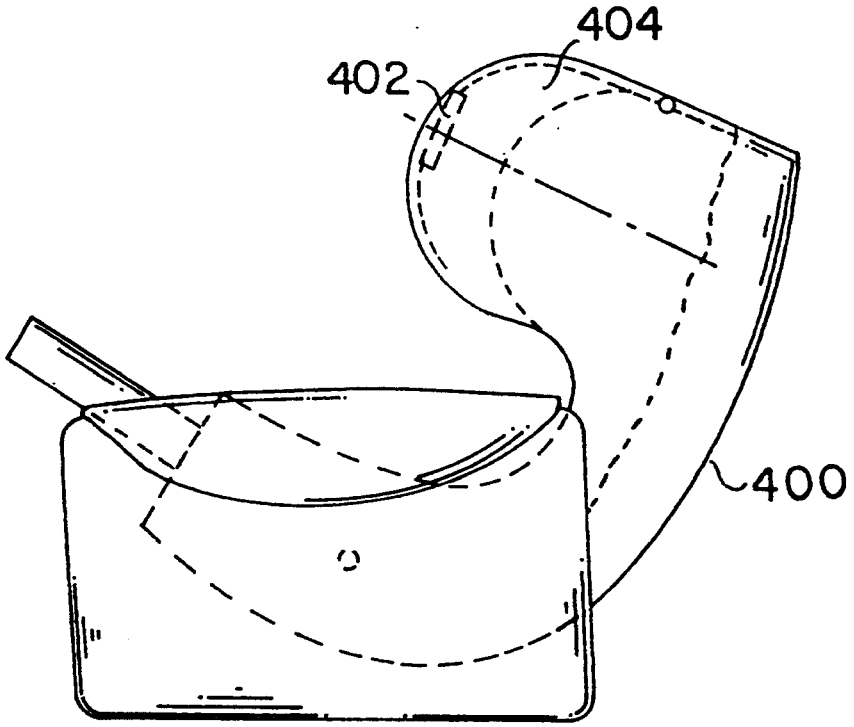
FIG. 23 is a side elevational view of the chair including a television screen in the hood for viewing by the operator of the chair.
Figure 24:
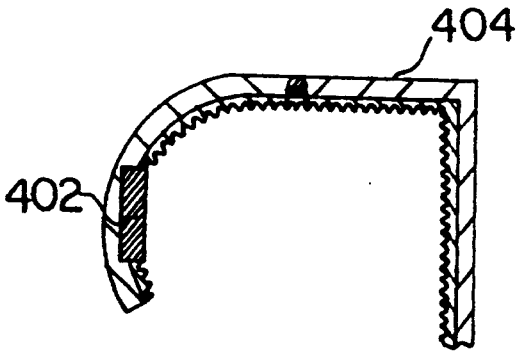
FIG. 24 is an enlarged section though the hood of the chair showing the placement of the television.

The chair of a further alternate embodiment as shown in FIGS. 23 and 24 further includes a television screen 402 in the hood facing an operator seated in the chair. The television screen is positioned at eye level of the operator seated in the chair. The hood 404 is designed with vertical portions in the pivoting cowl to place the interior surface of the cowl an additional 6" or so away from the user. This arrangement allows the positioning of a LCD-type television set or other visual device at the standard 14" plus or minus 10% from the user's eyes. The optical viewing distance is 14" from the eye. Adjustability is provided. The hood also functions to shield off visual light distractions from the operator whether viewing the television or listening to audio sound which could be an encumbrance if not so shielded.

The present invention is an improvement over my presently pending application in three specific aspects. The first aspect is the nature in which the central portion of the chair pivots about a single pivot point with respect to the fixed arms. Pivoting of the central part is totally by electric motor controlled by the user. In the prior application, the central portion pivoted along with the arms about a particular point. It is just different and appears to be a preferred point of comfort for most users.

What is claimed is:

1. A chair having fixed arm portions internally spaced from each other and a pivotable central portion with a head end and a foot end therebetween, hinges coupling the arm portions and the central portion, and sound creating means within the central portion under the control of an operator whereby, when seated in the chair, an operator may audially and tactically enjoy the created sound, the sound creating means including speakers facing each other in the head end of the central portion and a hood pivotally secured to the head end between the speakers.

2. The chair as set forth in claim 1 and further including a television screen in the hood facing an operator seated on the central portion.

3. The chair as set forth in claim 2 wherein the television screen is above eye level of an operator seated on the central portion.

4. A chair comprising:

fixed arm portions laterally spaced from each other and a pivotable central portion therebetween the central portion having a head end and a foot end;

hinge means for coupling the arm portions and the central portion;

control means under the control of the operator sitting on the central portion to effect the pivoting of the central portion with respect to the arm portions;

a foot rest with adjustment means coupling the foot rest to the foot end of the central portion, the adjustment means having horizontal means reciprocable into and out of the central portion and depending means fixedly secured within the foot rest and a pivoting component between the horizontal and depending means;

sound creating means within the central portion under the control of the operator whereby, when seated in the chair, the operator may audially and tactically enjoy the created sound, the sound creating means including speakers facing each other in the head end of the central portion; and a hood pivotally secured to the head end at an upper extent of the head end between the speakers.

* * * * *